US007415952B2

(12) United States Patent
Sato

(10) Patent No.: US 7,415,952 B2
(45) Date of Patent: Aug. 26, 2008

(54) VALVE TIMING CONTROL DEVICE

(75) Inventor: Atsushi Sato, Toyota (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 11/765,713

(22) Filed: Jun. 20, 2007

(65) Prior Publication Data

US 2008/0017145 A1 Jan. 24, 2008

(30) Foreign Application Priority Data

Jul. 19, 2006 (JP) ..... 2006-196639

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 5,937,810 A 8/1999 Sato et al.
2003/0196618 A1* 10/2003 Simpson ..... 123/90.15

FOREIGN PATENT DOCUMENTS

JP 9-151711 A 6/1997

* cited by examiner

*Primary Examiner*—Zelalem Eshete
(74) *Attorney, Agent, or Firm*—Buchanan Ingersoll & Rooney PC

(57) ABSTRACT

A valve timing control device includes a rotational shaft, a rotational torque transmitting member attached to the rotational shaft, a plurality of vanes each attached to the rotational shaft or the rotational torque transmitting device, a plurality of fluid chambers formed between the rotational shaft and the rotational torque transmitting device, a plurality of first chambers and second chambers, the fluid chambers each divided by means of each vane into each first chamber and each second chamber, a plurality of first fluid passages through each of which fluid is supplied to or drained from the each first chamber, a plurality of second fluid passages through each of which the fluid is supplied to or drained from the each second chamber, passage opening/closing device for opening/closing the first fluid passage or the second fluid passage, and chamber opening/closing device for opening/closing the first chamber and the second chamber.

8 Claims, 3 Drawing Sheets

VALVE TIMING CONTROL DEVICE

This application is based on and claims priority under 35 U.S.C. § 119 to Japanese Patent Application 2006-196639, filed on Jul. 19, 2006, the entire content of which is incorporated herein by reference.

FIELD OF THE INVENTION

The present invention relates to a valve timing control device controlling a timing of the intake and exhaust valves of an internal combustion engine.

BACKGROUND

A known valve timing control device adapted to change an opening/closing timing of an intake valve or an exhaust valve in response to a driving condition of an internal combustion engine is attached to one end of a camshaft.

The valve timing control device disclosed in, for example, JPH09-151711A is a vane type control device adapted to an internal combustion engine, which transmits an engine torque from a crankshaft to a camshaft by means of a torque transmitting means such as a timing belt or a timing chain. Further, a rotor, to which plural vanes extending in a radial direction, is fixed to the camshaft, and a timing pulley is coaxially fitted to the rotor so as to form plural hydraulic pressure chambers therein roundly, and each vane is inserted into each hydraulic pressure chamber so as to function as a piston.

In this configuration, a valve timing control device is executed by changing a relative phase between the camshaft and the timing pulley by applying hydraulic pressure for an advancing angle or hydraulic pressure for a retarding angle into a first hydraulic pressure chamber or a second hydraulic pressure chamber of the hydraulic pressure chambers, the hydraulic pressure chambers being divided into the first hydraulic pressure chamber and the second hydraulic pressure chamber by means of the vane.

Specifically, the valve timing control device includes a rotor (17) having plural vanes (18) extending in a radial direction and a housing member (19) in which the rotor (17) is provided. Between the rotor (17) and the housing member (19), hydraulic pressure chambers, arranged so as to be in a round shape, are formed, and each vane (18) is positioned in each hydraulic pressure chamber, and fluid for the advancing angle and for the retarding angle flows therein.

A fluid passage including a main passage (27) extending in an axial direction of the camshaft and a branch passage (13) extending in a radial direction from the main passage (27) is provided at one of a first hydraulic pressure chamber (30) and a second hydraulic pressure chamber (31) formed by dividing the hydraulic pressure chamber by means of each vane (18), and the fluid is introduced through the fluid passage. Because the fluid is introduced through the branch passage (13) simultaneously and evenly into the each hydraulic pressure chamber, responsiveness and smoothness of the operation of the valve timing control has been improved.

Generally, when an engine speed is low, the amount of the hydraulic oil is low. Therefore, pressure applied to the hydraulic pressure chambers is small.

Thus, in order to secure a necessary rotation force, more hydraulic pressure chambers are needed. For example, at the valve timing control device, six chambers are provided. On the other hand, when the engine speed is high, the amount of the hydraulic oil is high. Therefore, rotation force at each chamber is relatively large. Thus, even when the number of the hydraulic pressure chambers is small, a necessary torque for the valve timing control operation can be obtained. However, when the rotation speed of the engine is high, the rotation speed of the camshaft is also high. Therefore, the operation speed of the valve timing control needs to be increased so as to be higher than that in the low rotation speed.

A need thus exists to provide a technology by which the drive torque of the valve timing control device is secured under a condition where the speed of the internal combustion engine is low, and where the amount of the supplied hydraulic oil is low. At the same time, the response speed of the valve timing control device is improved under a condition where the speed of the internal combustion engine is high, and where the amount of the supplied hydraulic oil is high.

SUMMARY OF THE INVENTION

According to an aspect of the present invention, a valve timing control device includes a rotational shaft for controlling a valve, a rotational torque transmitting member attached to the rotational shaft so as to be relatively rotatable within a predetermined range and transmitting a rotational torque transmitted from a crankshaft pulley, a plurality of vanes attached to one of the rotational shaft and the rotational torque transmitting means, a plurality of fluid chambers formed between the rotational shaft and the rotational torque transmitting means, a plurality of first chambers and second chambers, the fluid chambers each divided by means of each vane into each first chamber and each second chamber, a plurality of first fluid passages through each of which fluid is supplied to or drained from the each first chamber, a plurality of second fluid passages through each of which the fluid is supplied to or drained from the each second chamber, passage opening/closing means for opening/closing at least one of at least one of the first fluid passages and at least one of the second fluid passages and chamber opening/closing means for opening/closing at least one of at least one of the first chambers and at least one of the second chambers.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
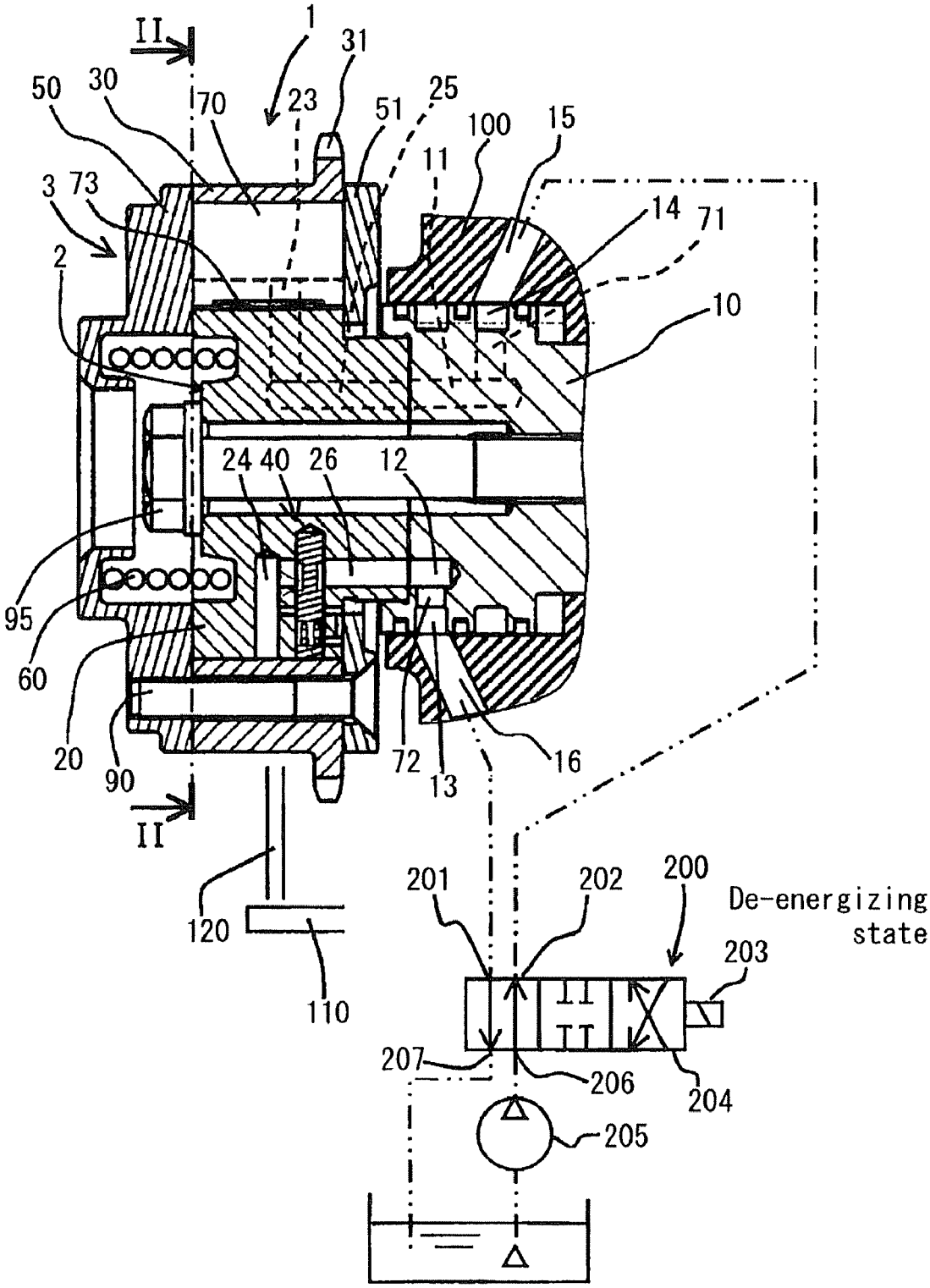
FIG. 1 illustrates a cross section seen in a line I-I indicating an embodiment of a valve timing control device related to the present invention.

An embodiment of a valve timing control device related to the present invention will be explained in accordance with the attached drawings.

A valve timing control device 1 illustrated in FIGS. 1 through 4 includes a camshaft 10 rotatably supported by a cylinder head 100 of an internal combustion engine and a rotor member 2 for a valve control comprised of a rotor 20 (e.g., a rotational shaft) mounted to an end portion of the camshaft 10 so as to be integral.

The valve timing control device 1 further includes a housing member 3 comprised of a housing 30 (e.g., rotational torque transmitting member), a front plate 50 and a rear plate 51, which are mounted to the rotor 20 so as to be integrally rotatable within a predetermined range.

A timing sprocket 31 is integrally formed at an outer peripheral of the housing 30. The valve timing control device 1 further includes a torsion spring 60, five vanes 70 each mounted to the rotor 20 and a lock key 80 mounted to the housing 30. The torsion spring 60 is provided between the rotor 20 and the front plate 50 so as to be connected therebetween.

Figure 2:
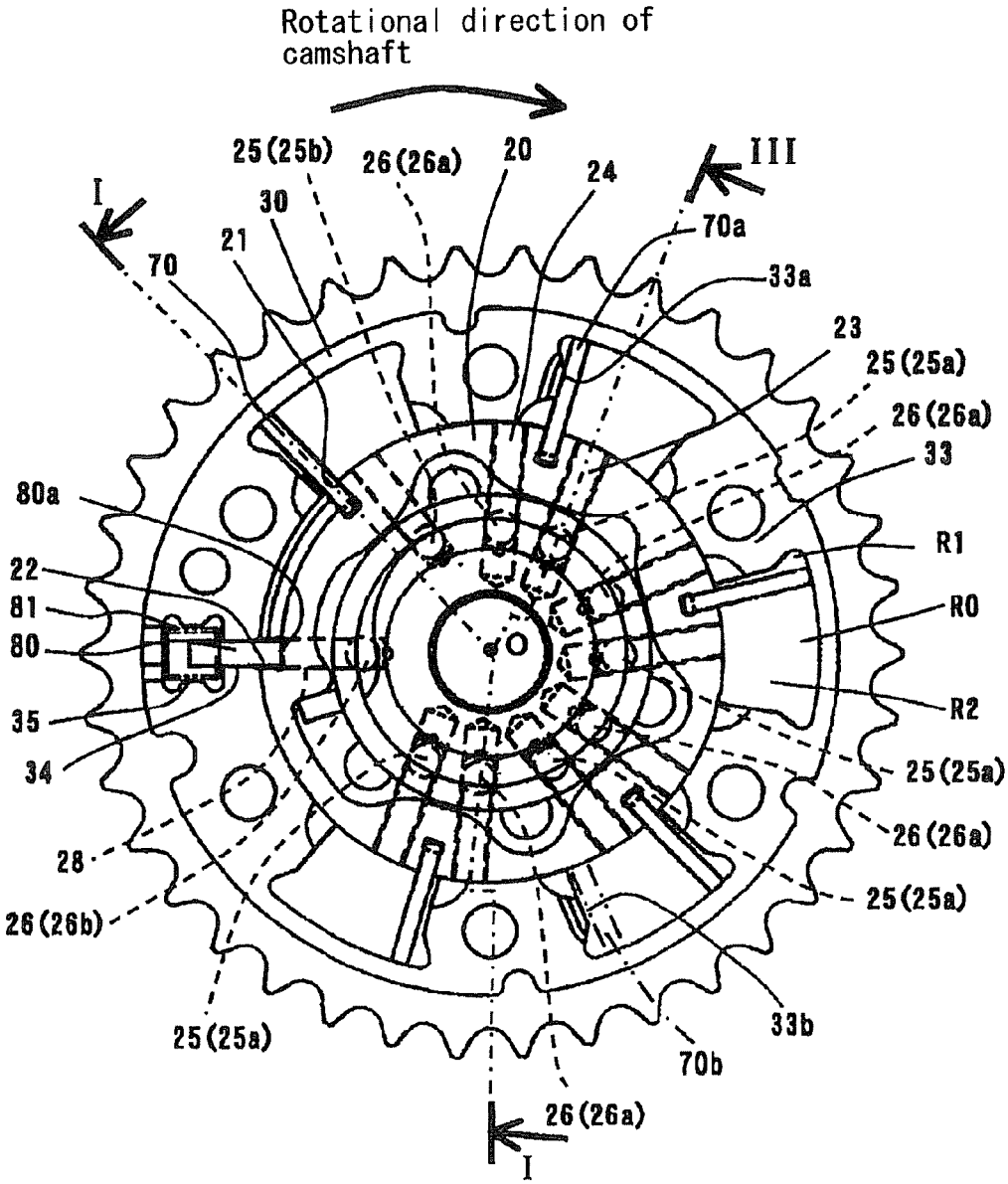
FIG. 2 illustrates a cross section of the valve timing control device in FIG. 1 seen along a II-II line.

In a conventional manner, a rotational torque from the crankshaft 110 (e.g., a crankshaft pulley) is transmitted to the timing sprocket 31 by means of a crank sprocket (not shown) and a timing chain 120, so as to rotate the timing sprocket 31 in a clockwise direction indicated with an arrow of a rotational direction of the camshaft in FIG. 2.

In the embodiment, the rotational torque is transmitted from the crankshaft 110 of the internal combustion engine to the timing sprocket 21 of the housing 30 by means of the timing chain 120, however, the configuration may be modified. For example, the torque may be transmitted from the crankshaft 110 to the timing sprocket 31 by means of a belt member instead of the timing chain 120, or by means of a pulley instead of the timing sprocket 31.

The camshaft 10 includes a known cam (not shown) for opening and closing an exhaust valve (not shown), and at an inner portion of the camshaft 10, a retarding angle fluid passage (hydraulic pressure circuit) 11 and an advancing angle fluid passage (hydraulic pressure circuit) 12 are provided. Both the retarding angle fluid passage and the advancing angle fluid passage are formed so as to extend in an axial direction of the camshaft 10.

The retarding angle fluid passage 11 is connected to a first connecting port 202 of a switching valve 200 via a passage 71, an annular groove 14 and a connecting passage 15. The passage 71 and the annular groove 14 are formed at the camshaft 10 so as to extend in a radial direction thereof, and the connecting passage 15 is formed at the cylinder head 100.

The advancing angle fluid passage 12 is connected to a second connecting port 201 of the switching valve 200 via a passage 72, an annular groove 13 and a connecting passage 16. The passage 72 and the annular groove 13 are formed at the camshaft so as to extend in a radial direction of the camshaft 10, and the connecting passage 16 is formed at the cylinder head 100.

The switching valve 200 has a known configuration where a spool 204 is moved by energizing a solenoid 203 against a biasing force applied by a spring. When the solenoid 203 is energized, a supply port 206, which is connected to an oil pump 205, communicates with the first connecting port 201, and the second connecting port 202 communicates with a drain port 207. The oil pump 205 is driven by the internal combustion engine. On the other hand, when the solenoid 203 is not energized, as illustrated in FIG. 1, the supply port 206 communicates with the second connecting port 202, and the first connecting port 201 communicates with the drain port 207.

In this configuration, when the switching valve 200 is energized, the hydraulic oil (hydraulic pressure) is supplied to the advancing angle fluid passage 12, and when the switching valve 200 is not energized, the hydraulic oil (hydraulic pressure) is supplied to the retarding angle fluid passage 11. The switching valve 200 is duty-controlled in a manner where a ratio of the energizing and a ratio of the de-energizing per a unit time are controlled. For example, the switching valve 20 is controlled at 50:50 duty ratio, the first connecting port 201 and the second connecting port 202 do not communicate with the drain port 206 and the drain port 207.

A through hole is formed at a center of the rotor 20 so as to extend in an axial direction thereof, and a single bolt 95 is inserted into the through hole and tightened so that the rotor 20 can be integrally fixed to the camshaft 10 so as to form the rotor member 2. Five vane grooves 21 and a single lock groove 22 are formed at the rotor 20.

Each vane 70 is attached to each vane groove 21 so as to radially move. A vane spring 73 is provided between a bottom portion of the vane groove 21 and at an under surface of the vane 70. In this configuration, because the vane 70 is biased outwardly by means of the vane spring 73, the vane 70 slides on a slide surface of the housing 30 by contacting thereto.

When a rotational position of the camshaft 10 relative to the housing 30 and a rotational position of the rotor 20 relative to the housing 30 synchronize each other at a predetermined phase (most retarding angle position), the lock key 80 is positioned in a manner where a part of the lock key 80 is inserted at a predetermined amount into the lock groove 22.

The rotor 20 further includes five retarding angle fluid passages 23, four advancing angle fluid passages 24 and a single lock fluid passage 28, which are extending in a radial direction of the rotor 20. The lock fluid passage 28 also serves as the advancing angle fluid passage.

Each retarding angle fluid passage 23 communicates with the retarding angle fluid passage 11 via a retarding angle fluid passage 25 (e.g., second fluid passage) formed in an axial direction. The retarding angle fluid passage 11 further communicates with the retarding angle connection passage 15 via the fluid passage 71 and the retarding angle annular groove 14. The fluid passage 71 is formed so as to extend in a radial direction of the camshaft 10.

The advancing angle fluid passage 24 and the lock fluid passage 28, serving as the advancing angle fluid passage, communicate with the advancing angle fluid passage 12 via an advancing angle fluid passage 26 (e.g., first fluid passage) extending in an axial direction of the camshaft 10. The advancing angle fluid passage 12 communicates with the advancing angle connection passage 16 via the fluid passage 72, formed in a radial direction of the camshaft 10, and the advancing angle annular groove 13.

At each of the four advancing angle fluid passages 26*a* and each of the four retarding angle fluid passages 25*a*, an opening-closing valve 40 (e.g., a passage opening/closing means and a chamber opening/closing means) is provided so as to be orthogonal to the passages and movable in an radial direction of the crankshaft 10.

A configuration of the opening-closing valve 40 will be explained taking the opening-closing valve 40 provided at the retarding angle fluid passage 25*a* as an example. The same configuration will be applied to the other opening-closing valves 40 provided at both of the advancing angle fluid passages 26*a* and the retarding angle fluid passages 25*a*.

The opening-closing valve 40 includes a valve body 41 (e.g., valve member) and a coil spring 42 (e.g., biasing member). The coil spring 42 is made of an elastic member and provided in order to apply a biasing force to the valve body 41 toward a shaft center of the camshaft 20. The valve body 41 is formed in a column shape, and a diameter at a central portion in a longitudinal direction thereof is narrower than a diameter at other portions thereof. Specifically, the valve body includes three portions, an inner portion, a central portion and an outer portion. The inner portion is formed at an inner side of the valve body 41 in a radial direction of the camshaft 10, the outer portion is formed at an outer side of the valve body 41 in a radial direction of the camshaft 10 and the central portion is formed between the inner portion and the outer portion. The inner portion and the outer portion have an identical diameter, and the central portion has a diameter being narrower than the diameter of the inner and outer portions.

The inner portion of the valve body 41 functions so as to open/close the retarding angle fluid passage 25*a*, and the outer portion of the valve body 41 functions so as to open/close an communicating hole 43 provided for communicating the retarding angle fluid passages 23 with air.

Figure 3A:
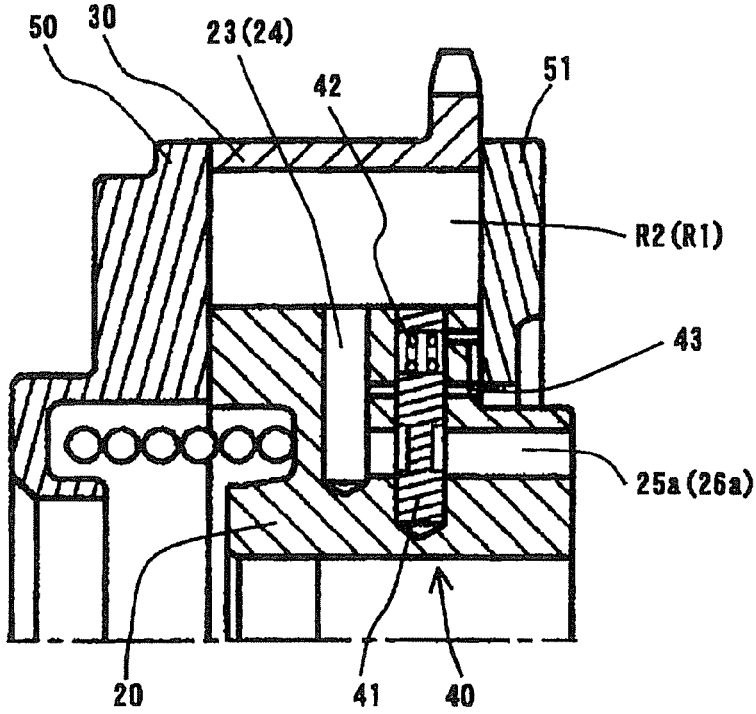
FIG. 3A illustrates a cross section of the valve timing control device in FIG. 2 seen along a III-O line, where an opening-closing valve is in a closes state.
Figure 3B:
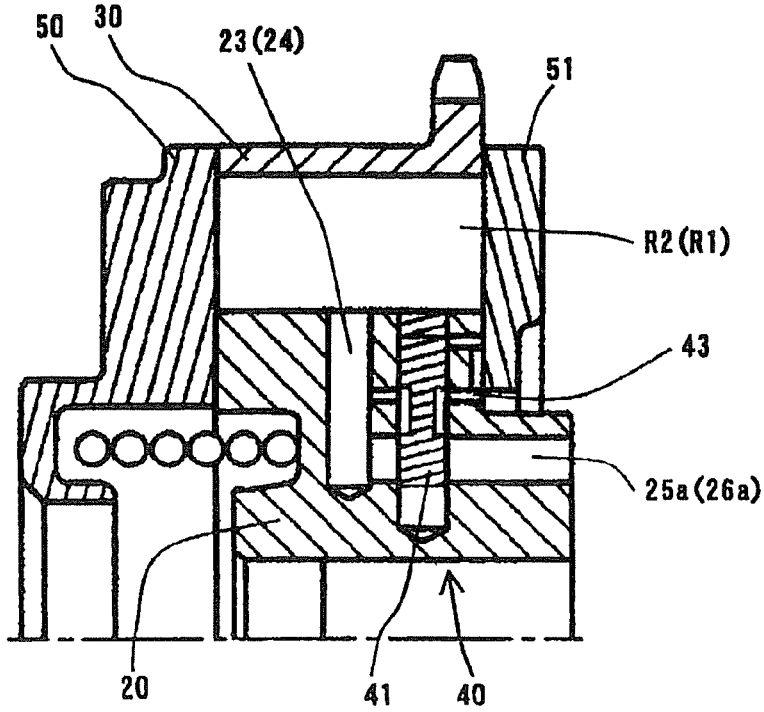
FIG. 3B illustrates a cross section of the valve timing control device in FIG. 2 seen along a III-O line, where the opening-closing valve is in an opened state.

In this configuration, when the retarding angle fluid passage 25*a* is in an opened state, the communicating hole 43 is in a closed state as illustrated in FIG. 3A, and when the retarding angle fluid passage 25*a* is in a closed state, the communicating hole 43 is in an opened state as illustrated in FIG. 3B.

As illustrated in FIG. 1, the housing member 3 includes the housing 30, the front plate 50 and the rear plate 51. Specifically, the front plate 50, the rear plate 51 and the housing 30 are fixed together so as to be integral by means of plural bolts 90. In this embodiment, six bolts 90 are used. The housing member 3, which is an integration of the housing 30, the front plate 50 and the rear plate 51, is attached to the outer peripheral surface of the rotor 20 so as to make a relative rotation within a predetermined angle.

The timing sprocket 31 is integrally formed on an outer peripheral of the housing 30, and five projecting portions 33 are formed on an inner peripheral surface of the housing 30. The housing 30 is rotatably supported by the rotor 20 in a manner where an inner peripheral surface of each projecting portion 33 contacts an outer peripheral surface of the rotor 20.

At one of the projecting portions 33, a withdrawal groove 34 housing the lock key 80 and a housing hole 35 housing the spring 81 are formed. The spring 81 housed in the housing hole 35 biases the lock key 80 so as to move inward in an radial direction of the camshaft 10.

A fluid chamber R0, defined with the housing 30, the rotor 20 and two projecting portions 33 being adjacent to each other in a circumference direction, are formed in compartments by each vane 70 so as to form two chambers, an advancing angle fluid chamber R1 (e.g., first chamber) and an retarding angle fluid chamber R2 (e.g., second chamber).

At a most retarding angle side, a relative rotation between the rotor 20 and the housing 30 is limited in a manner where the vane 70 (illustrated as a vane 70*a*) contacts one surface 33*a* of the projecting portion 33 in a circumferential direction of the rotor 20, and at a most advancing angle side, the relative rotation between the rotor 20 and the housing 30 is limited in a manner where the vane 70 (illustrated as a vane 70*b*) contacts the other surface 33*b* of the projecting portion 33 in the circumferential direction of the rotor 20. At the retarding angle side, because the lock key 80 is inserted into the lock groove 22, the relative rotation between the rotor 20 and the housing 30 is limited.

The torsion spring 60 is provided between the front plate 50 and the rotor 20 in a manner where one end of the torsion spring 60 is connected to the front plate 50, and the other end of the torsion spring 60 is connected to the rotor 20, so as to apply a biasing force to the rotor 20 in the advancing angle side (in a clockwise direction in FIG. 2) so that the rotor 20 can rotate relative to the housing 30, the front plate 50 and the rear plate 51. In this configuration, an actuation response of the rotor 20 in an advancing angle direction is increased.

An operation of the valve timing control device 1 in the embodiment having the abovementioned configuration will be explained in detail. While the internal combustion engine is stopped, the oil pump 205 is also stopped, therefore the switching valve is de-energized, and the hydraulic oil (hydraulic pressure) is not supplied to the fluid chamber R0. At this point, as illustrated in FIG. 2, the lock key 80 inserts into the lock groove 22 in order to limit the relative rotation between the rotor 20 and the housing 30.

When the internal combustion engine starts, and the oil pump 205 is operated, during a period in which a duty ratio for emerging the switching valve 200 is small (while the ratio of the energizing time period relative to the de-energizing time period per unit time is small), the hydraulic oil (hydraulic pressure) is supplied only to the retarding angle fluid chamber R2 through the connecting passage 15, the retarding angle fluid passage 11 and the retarding angle fluid passage 25, so that the valve timing control device 1 can be maintained to be in the locked state.

Under a certain driving condition of the internal combustion engine, when the rotor 20 needs to be rotated in the advancing angle direction in order to control the valve timing, the duty ratio of the electric power supplied to the switching valve 200 is increased, and the position of the spool 204 is changed.

Further, the hydraulic oil (hydraulic pressure) is supplied from the oil pump 205 to the advancing angle fluid chamber R1 through the connecting passage 16 and the advancing angle fluid passages 12, 26 and 24.

At the same time, the hydraulic oil (hydraulic pressure) is also supplied to the lock groove 22 through the lock fluid passage 28, serving also as the advancing angle fluid passage, and is eventually introduced toward an end portion 80*a* of the lock key 80.

At this point, because the hydraulic pressure is applied to the end portion 80*a* of the lock key 80 in an outward direction, the lock key 80 is pushed out from the lock groove 22. As a result, the rotor 20 becomes rotatable relative to the housing 30.

On the other hand, the hydraulic oil (hydraulic pressure) in the retarding angle fluid chamber R2 is drained through the connecting passage 15 and discharged from the drain port 207 of the switching valve 200. As a result, the rotor 20 is rotated relative to the housing 30 in the advancing angle direction. When the side surface of the vane 70*b* contacts to the side surface 33*b* of the projecting portion 33, the rotation of the rotor 20 relative to the housing 30 in the advancing angle direction is limited.

Under a certain driving condition of the internal combustion engine, when the rotor 20 needs to be rotated in the retarding angle direction in order to control the valve timing, the duty ratio of the electric power supplied to the switching valve 200 in decreased, and the position of the spool 204 is changed. The hydraulic oil (hydraulic pressure) is supplied from the oil pump 205 to the retarding angle fluid chamber R2 through the connecting passage 15 and the advancing angle fluid passages 11 and 23.

On the other hand, the hydraulic oil (hydraulic pressure) is drained from the in the advancing angle fluid chamber R1 through the advancing angle fluid passages 24 and 12 and the connecting passage 16 and discharged from the drain port 207 of the switching valve 200. As a result, the rotor 20 is rotated relative to the housing 30 in the retarding angle direction. When the side surface of the vane 70*a* contacts to the side surface 33*a* of the projecting portion 33, the rotation of the rotor 20 relative to the housing 30 in the retarding angle direction is limited.

Then, after the hydraulic oil (hydraulic pressure) is drained from the lock groove 22, the lock key 80 provided at the housing 30 is moved so as to be inserted into the lock groove 22. As a result, the rotation of the rotor 20 relative to the housing 30 is limited.

As illustrated in FIG. 3, while the internal combustion engine is stopped or rotated at low speed, the valve body 41 is biased by the coil spring 42 toward the shaft center of the camshaft 10. As a result, the opening-closing valve 40 changes to an opened state. While the valve body 41 is in the opened state, the hydraulic oil passes through the advancing angle fluid passage 26*a* and the retarding angle fluid passage 25*a* respectively.

At this point, because the communicating hole 43 is in a closed state, the hydraulic oil does not flow toward a side containing air. When the internal combustion engine rotates so as to be higher than a predetermined speed, because of a centrifugal force, the valve body is moved outward in a radial direction of the camshaft 10 as illustrated in FIG. 4 against the biasing force applied by the coil spring. At this point, the advancing angle fluid passage 26*a* and the retarding angle fluid passage 25*a* are in a closed state so that the hydraulic oil does not flow therein and thereout. At the same time, the communicating hole 43 changes to an opened state, and the advancing angle fluid chamber R1 and the retarding angle fluid chamber R2 communicate with the side containing air.

Specifically, when the internal combustion engine rotates at low speed, and the amount of the hydraulic oil is low, the hydraulic oil is supplied to the five fluid chambers R0 in order to maintain the operation force of the valve timing control device 1.

On the other hand, when the internal combustion engine rotates at a high speed, and the amount of the hydraulic oil is high, the hydraulic oil is not supplied to the four fluid chambers R0 at which the opening-closing valves 40 are provided, and the four fluid chambers R0 communicate with the air. Thus, the four fluid chambers R0 do not relate to the operation of the valve timing control device 1, and the valve timing control device 1 is operated by one fluid chamber R0. As a result, when the amount of the hydraulic oil is high, the fluid chamber R0 operates at a speed five-times faster than the case where the five fluid chambers R0 are operated.

In the embodiment, the opening-closing valve 40 is provided at each of the advancing angle fluid passage 26*a* and the retarding angle fluid passage 25*a* of each of the four fluid chambers R0, however, the number of the opening-closing valve 40 may be changed.

Further, in the embodiment, the single opening-closing valve 40 is used to open/close the advancing angle fluid passage 26*a* or the retarding angle fluid passage 25*a* and the communicating hole 43, however, the advancing angle fluid passage 26*a*, the retarding angle fluid passage 25*a* and the communicating hole 43 may be opened/closed by a valve body provided respectively.

According to the embodiment of the present invention, the valve timing control device includes a first fluid passage through which fluid is supplied to or drained from the first chamber, a second fluid passage through which the fluid is supplied to or drained from the second chamber, a passage opening/closing means for opening/closing one of the first fluid passage and the second fluid passage and a chamber opening/closing means for opening/closing one of the first chamber and the second chamber. In this configuration, when the speed of the internal combustion engine is low, the amount of the hydraulic oil is low, and the hydraulic pressure is low; all of the first fluid passages and the second fluid passages are controlled so as to be in an opened state, at the same time, all of the first chambers and the second chambers are controlled so as to be in a closed state, in order to secure a necessary drive torque.

Further, when the speed of the internal combustion engine is high, the amount of the hydraulic oil is high, and the hydraulic pressure is high; some of the first fluid passages and the second fluid passages are controlled so as to be in a closed state, at the same time, the first chambers and the second chambers, which are corresponding to the closed fluid passages, are controlled so as to be in an opened state, so that the small amount of hydraulic oil can be supplied to the fluid chambers. As a result, the response speed of the valve timing control device may be further improved.

The passage opening/closing means opens/closes one of the first fluid passage and the second fluid passage on the basis of a speed of one of the rotational shaft and the rotational torque transmitting means, and the chamber opening/closing means opens/closes one of the first chamber and the second chamber on the basis of a speed of one of the rotational shaft and the rotational torque transmitting means. Thus, the controls of the passage opening/closing means and the chamber opening/closing means are simplified.

The chamber opening/closing means changes to a closed state while the passage opening/closing means is in an opened state, and the chamber opening/closing means changes to an opened state while the passage opening/closing means is in a closed state. Thus, the pressure of the hydraulic oil may be used effectively, and the valve timing control device is smoothly operated.

The passage opening/closing means includes a valve member and a biasing member, and the biasing member applies a biasing force to the valve member so that the valve member can move toward a shaft center of the rotational shaft, and the chamber opening/closing means includes a valve member and a biasing member, and the biasing member applies a biasing force to the valve member so that the valve member can move toward a shaft center of the rotational shaft. Thus, the rotational shaft and the rotational torque transmitting means may be operated by use of centrifugal force, and the structures of the passage opening/closing means and the chamber opening/closing means may be simplified.

The passage opening/closing means is changed from the opened state to the closed state when the speed of one of the rotational shaft and the rotational torque transmitting means reaches a predetermined speed. Thus, the passage opening/closing means may be controlled in accordance with the speed of the internal combustion engine.

The chamber opening/closing means is changed from the closed state to the opened state when the speed of one of the rotational shaft and the rotational torque transmitting means reaches a predetermined speed. Thus, the chamber opening/closing means may be controlled in accordance with the speed of the internal combustion engine.

The chamber opening/closing means opens/closes a communicating hole by which one of the first chamber and the second chamber communicates with the air. Thus, the hydraulic pressure in one of the first chamber and the second chamber may be released.

The valve member of the passage opening/closing means and the valve member of the chamber opening/closing member are formed so as to be integral. Thus, the structures of the passage opening/closing means and the chamber opening/closing means may be simplified.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A valve timing control device comprising:

a rotational shaft for controlling a valve;

a rotational torque transmitting member attached to the rotational shaft so as to be relatively rotatable within a predetermined range and transmitting a rotational torque transmitted from a crankshaft pulley;

a plurality of vanes attached to one of the rotational shaft and the rotational torque transmitting means;

a plurality of fluid chambers formed between the rotational shaft and the rotational torque transmitting means;

a plurality of first chambers and second chambers;

the fluid chambers each divided by means of each vane into each first chamber and each second chamber;

a plurality of first fluid passages through each of which fluid is supplied to or drained from the each first chamber;

a plurality of second fluid passages through each of which the fluid is supplied to or drained from the each second chamber;

passage opening/closing means for opening/closing at least one of at least one of the first fluid passages and at least one of the second fluid passages; and chamber opening/closing means for opening/closing at least one of at least one of the first chambers and at least one of the second chambers.

2. The valve timing control device according to claim 1, wherein the passage opening/closing means opens/closes the at least one of the at least one of the first fluid passages and the at least one of the second fluid passages on the basis of a speed of one of the rotational shaft and the rotational torque transmitting means, and the chamber opening/closing means opens/closes the at least one of the at least one of the first chambers and the at least one of the second chambers on the basis of a speed of one of the rotational shaft and the rotational torque transmitting means.

3. The valve timing control device according to claim 1, wherein the chamber opening/closing means changes to a closed state while the passage opening/closing means is in an opened state, and the chamber opening/closing means changes to an opened state while the passage opening/closing means is in a closed state.

4. The valve timing control device according to claim 1, wherein the passage opening/closing means includes a valve member and a biasing member, and the biasing member applies a biasing force to the valve member so that the valve member moves toward a shaft center of the rotational shaft, and the chamber opening/closing means includes a valve member and a biasing member, and the biasing member applies a biasing force to the valve member so that the valve member moves toward a shaft center of the rotational shaft.

5. The valve timing control device according to claim 4, wherein the passage opening/closing means is changed from an opened state to a closed state when the speed of one of the rotational shaft and the rotational torque transmitting means reaches a predetermined speed.

6. The valve timing control device according to claim 4, wherein the chamber opening/closing means is changed from a closed state to an opened state when the speed of one of the rotational shaft and the rotational torque transmitting means reaches a predetermined speed.

7. The valve timing control device according to claim 1, wherein the chamber opening/closing means opens/closes a communicating hole by which the at least one of the at least one of the first chambers and the at least one of the second chambers communicates with air.

8. The valve timing control device according to claim 1 wherein the valve member of the passage opening/closing means and the valve member of the chamber opening/closing member are formed so as to be integral.

* * * * *